US010166756B2

(12) United States Patent
Müller et al.

(10) Patent No.: US 10,166,756 B2
(45) Date of Patent: Jan. 1, 2019

(54) TEMPERATURE CONTROL ASSEMBLY FOR CONTROLLING THE TEMPERATURE OF A FUNCTIONAL PARTS OF A PRINTING MACHINE, AND PRINTING SYSTEM COMPRISING AT LEAST ONE PRINTING MACHINE AND A TEMPERATURE CONTROL ASSEMBLY

(71) Applicant: KOENIG & BAUER AG, Würzburg (DE)

(72) Inventors: Daniela Müller, Veitschöchheim (DE); Roland Pfister, Gössenheim-Sachsenheim (DE)

(73) Assignee: Koenig & Bauer AG, Wurzburg (DE)

( * ) Notice: Subject to any disclaimer, the term of this patent is extended or adjusted under 35 U.S.C. 154(b) by 58 days.

(21) Appl. No.: 15/524,277

(22) PCT Filed: Dec. 15, 2015

(86) PCT No.: PCT/EP2015/079788
§ 371 (c)(1),
(2) Date: May 4, 2017

(87) PCT Pub. No.: WO2016/124283
PCT Pub. Date: Aug. 11, 2016

(65) Prior Publication Data

US 2018/0304612 A1 Oct. 25, 2018

(30) Foreign Application Priority Data

Feb. 6, 2015 (DE) ..... 10 2015 202 183

(51) Int. Cl.
*B41F 13/22* (2006.01)
*B41F 31/00* (2006.01)
(Continued)

(52) U.S. Cl.
CPC ..... *B41F 13/22* (2013.01); *B41F 31/002* (2013.01); *B41J 2/17596* (2013.01);
(Continued)

(58) Field of Classification Search
None
See application file for complete search history.

(56) References Cited

U.S. PATENT DOCUMENTS 1,568,382 A 1/1926 Otten
5,595,115 A * 1/1997 Rau ..... B41F 7/37 101/142
(Continued)

FOREIGN PATENT DOCUMENTS

DE 102007003619 A1 8/2007
EP 1644901 A1 4/2006
(Continued)

OTHER PUBLICATIONS

International Search Report of PCT/EP2015/079788 dated Mar. 17, 2016.

*Primary Examiner* — Jill E Culler
(74) *Attorney, Agent, or Firm* — Mattingly & Malur, PC

(57) ABSTRACT

A temperature control assembly controls the temperature of functional parts of a printing machine. The temperature control assembly comprises a plurality of assembly-side sub-circuits, the temperature of which is to be individually controlled, each sub-circuit having a temperature-control fluid outlet and a temperature-control fluid inlet, on each of which, in order to form a respective temperature control circuit, one or more functional parts can be connected as loads of a temperature-controlling external temperature control sub-circuit by the use of releasable connections, and which, on the feed side of the temperature control thereof, are or can be thermally and fluidically coupled, via respec-
(Continued)

tive removal points, to a common feed line, and on the return side, via each return point, to a common fluid return. The temperature control assembly is configured as a structurally independent assembly comprising the assembly-side temperature control circuits thereof and the feed and return, and a temperature control device that controls the temperature of the temperature control fluid supplied to the feed, one of on and in a single-component or in a multi-component frame of the temperature control assembly. The temperature control device is provided in a fluid stream between the last return point and the first removal point. A line section of the feed line, which extends at least over the length from the first removal point to the last downward removal point of the assembly-side temperature control circuit, has an average line cross-section which is one of greater than a multiple of the average line cross-section of a supply line section arranged in the feed downstream of the temperature control device and arranged upstream of the line section, and which is greater than a multiple of a line a cross-section upstream of each of the largest return point.

15 Claims, 5 Drawing Sheets

(51) Int. Cl.

| | |
|---|---|
| ***B41J 29/393*** | (2006.01) |
| ***B41J 2/175*** | (2006.01) |
| ***B41J 29/377*** | (2006.01) |

(52) U.S. Cl.
CPC ..... *B41J 29/377* (2013.01); *B41J 29/393* (2013.01); *B41F 31/005* (2013.01)

(56) References Cited

U.S. PATENT DOCUMENTS

| | | | | |
|---|---|---|---|---|
| 5,611,278 | A * | 3/1997 | Garner | B41F 31/002 101/349.1 |
| 5,657,637 | A * | 8/1997 | Mertens | B41F 7/24 62/175 |
| 7,523,706 | B2 | 4/2009 | Schneider et al. | |
| 8,272,324 | B2 | 9/2012 | Müller et al. | |
| 8,328,194 | B2 | 12/2012 | Reinhard et al. | |
| 8,783,685 | B2 | 7/2014 | Reinhard et al. | |
| 9,174,474 | B2 | 11/2015 | Herbert et al. | |
| 2002/0112636 | A1* | 8/2002 | Desaulniers | B41F 31/002 101/487 |
| 2007/0068409 | A1* | 3/2007 | Hieronymus | B41F 13/22 101/350.1 |
| 2008/0017061 | A1* | 1/2008 | Muller | B41F 13/22 101/487 |
| 2011/0162545 | A1 | 7/2011 | Bolza-Schünemann | |
| 2015/0145918 | A1* | 5/2015 | Herbert | B41F 13/22 347/17 |

FOREIGN PATENT DOCUMENTS

| | | | |
|---|---|---|---|
| WO | 2005/008606 | A1 | 1/2005 |
| WO | 2006/072558 | A1 | 7/2006 |
| WO | 2010/029023 | A1 | 3/2010 |
| WO | 2011113619 | A1 | 9/2011 |
| WO | 2013/160074 | A1 | 10/2013 |

* cited by examiner

TEMPERATURE CONTROL ASSEMBLY FOR CONTROLLING THE TEMPERATURE OF A FUNCTIONAL PARTS OF A PRINTING MACHINE, AND PRINTING SYSTEM COMPRISING AT LEAST ONE PRINTING MACHINE AND A TEMPERATURE CONTROL ASSEMBLY

This application is the U.S. National Phase, under 35 U.S.C. § 371, of PCT/EP2015/079788, filed Dec. 15, 2015; published as WO 2016/124283A1 on Aug. 11, 2016 and claiming priority to DE 10 2015 202 183.1, filed Feb. 6, 2015, the disclosures of which are expressly incorporated herein by reference.

FIELD OF THE INVENTION

The present invention relates to a temperature control assembly for controlling the temperature of functional parts of a printing machine and to a printing system comprising at least one printing machine and a temperature control assembly. The temperature control assembly comprises a plurality of assembly-side temperature control subcircuits, the temperature of each of which is to be individually controlled. Each has a temperature control fluid outlet and a temperature control fluid inlet, to each of which, in order to form a respective temperature control circuit, an external temperature control subcircuit, that controls the temperature of one or more functional parts as loads, can be connected by releasable connections. On the feed side, the temperature control of each subcircuit is or can be thermally and/or fluidly coupled, via respective removal points, to a common feed line. On the return side, each subcircuit is or can be thermally and/or fluidly coupled, via respective removal points, to a common fluid return. The temperature control assembly is configured as a structurally independent assembly, comprising the assembly-side temperature control subcircuits thereof and the feed and return and a temperature control device that controls the temperature of the temperature control fluid to be supplied to the feed, on or in a single-part or a multi-part frame of the temperature control assembly. The temperature control device is provided in the fluid flow between the last return point and the first removal point. A printing system has at least one printing machine with a temperature control assembly for controlling the temperature of functional parts of the printing machine.

BACKGROUND OF THE INVENTION

WO 2013/160074 A1 relates to a temperature control assembly for controlling the temperature of functional parts of a printing machine, which assembly comprises a plurality of assembly-side temperature control subcircuits, the temperature of which is to be individually controlled, with each subcircuit comprising a temperature control fluid outlet and a temperature control fluid inlet. To each of these, an external temperature control subcircuit for controlling the temperature of one or more functional parts can be connected by means of releasable connections, in order to form a respective temperature control circuit. The assembly-side temperature control subcircuits, for the temperature control thereof, are or can be thermally and/or fluidically coupled on the feed side via respective removal points to a common fluid feed and on the return side via respective return points to a common fluid return. The temperature control assembly is configured as a structurally independent assembly comprising the assembly-side temperature control subcircuits, along with the feed and return and a temperature control unit that controls the temperature of the temperature control fluid supplied to the feed, on or in a single-part or multiple-part frame.

WO 2006/072558 A1 discloses a printing machine with printing towers, in which a supply unit for supplying temperature control fluid to temperature control circuits of the printing tower is assigned to a printing tower, and from these circuits, primary circuit fluid can be metered in selectively from two primary circuits for cooling or for preheating.

DE 10 2007 003619 A1 discloses a sheet-fed printing machine having a temperature control device, in which a primary loop cooled by a central temperature control device is provided, to which individual temperature control circuits are thermally coupled in the printing units in such a way that fluid is exchanged with the primary loop via a valve in order to control the temperature of the individual temperature control circuits.

WO 2011/113619 A1 discloses controlling the temperature of a printing tower, in which a primary circuit assigned to the printing tower comprises a feed line having a plurality of removal points for connected secondary circuits and a return line having a plurality of return points. The temperature of the primary circuit can be controlled by exchanging temperature control fluid with a higher-level temperature control fluid circuit, or the primary circuit can be self-contained, with its temperature being controlled by a temperature control device that controls the temperature of the fluid.

EP 1644901 B1 discloses a printing machine for processing sheets that comprises a plurality of modules including a numbering module.

U.S. Pat. No. 1,568,382 A relates to a device for conditioning ink rollers, in which the temperature is controlled by means of air streams directed toward the rollers. In said device, proceeding from a main supply line, the diameter and capacity of which are determined by the number of printing machines to be treated, are branch conduits that have relatively smaller cross-sections.

SUMMARY OF THE INVENTION

The object of the present invention is to provide a temperature control assembly for controlling the temperature of functional parts of a printing machine, and to provide a printing system that comprises at least one printing machine and a temperature control assembly.

The object is achieved according to the invention by the provision of a line section of the feed line which extends at least over a length from the first removal point to the last downstream removal point of the assembly-side temperature control subcircuits. The line section has an average cross section which, in the case of a number n of temperature control fluid outlets, corresponds to one of more than n times the average line cross-section of a supply line section arranged in the feed downstream of the temperature control device and upstream of the line section, and to more than n times a free line cross-section present at the respective or largest removal point.

The advantages to be achieved by the invention consist, in particular, in that a temperature control assembly that is especially compact and/or can be brought on line especially quickly for controlling the temperature of functional parts of a printing press is provided.

A temperature control assembly of this type comprises a plurality of assembly-side temperature control subcircuits, the temperature of which is to be individually controlled, each having a temperature control fluid outlet and a temperature control fluid inlet, to each of which, in order to form a respective temperature control circuit, an external temperature control subcircuit for controlling the temperature of one or more functional parts can be connected by releasable connections, wherein the assembly-side temperature control subcircuits can be or are thermally and/or fluidically coupled on the feed side for the temperature control thereof via respective removal points to a common fluid feed, and on the return side via respective return points to a common fluid return, and wherein the temperature control assembly is embodied as a structurally independent assembly comprising the assembly-side temperature control subcircuits thereof, along with the feed and return, and a temperature control device for controlling the temperature of the temperature control fluid to be supplied to the feed, on or in a single-part or multi-part frame of the temperature control assembly.

Particular advantages are now achieved, in particular, by the fact that the temperature control unit is provided in the fluid flow between the last return point and the first removal point, and by the fact that a first line section of the feed line, which extends at least over the length from the first removal point to the last downstream removal point of the assembly-side temperature control subcircuits, has an average free line cross-section that corresponds to at least a multiple of the average line cross-section of a supply line section arranged in the feed downstream of the temperature control device and upstream of said first line section, and/or corresponds to at least a multiple of the line cross-section of a free line cross-section for the temperature control unit, at the respective or largest removal point. Thus the feed line itself forms a sufficient reservoir for the temperature control fluid that is required for the connected temperature control medium circuits. In particular, the average line cross-section corresponds to at least the sum of the line cross-sections at the removal points of all the temperature control medium circuits.

Since the feed line is itself embodied as a reservoir and/or the entire return flow is conducted via a temperature control device and back to the feed, the feed time required to bring the system on line is decreased while at the same time, the number of components required and/or the amount of installation space required are reduced.

In a first advantageous refinement, parts of the temperature control subcircuits can be configured as modular, for example as temperature control modules or plug-in units. These temperature control modules or plug-in units each comprise, for example, at least means for thermally coupling the relevant temperature control circuit, and, for example, a drive means for pumping the fluid in the temperature control circuit, and interfaces for coupling line sections of the temperature control module in question to at least the feed line and the return line. The temperature control device can also comprise a plurality of prepared coupling sites, for example in the form of plug-in sites, not all of which must be occupied by plug-in units.

Finally, it is particularly advantageous to provide such a temperature control assembly in a printing machine that is used for security printing, in particular for the printing of banknotes, for example a security printing machine, in particular a printing machine that comprises a numbering unit.

BRIEF DESCRIPTION OF THE DRAWINGS

Exemplary embodiments of the invention are illustrated in the set of drawings and will be described in greater detail in the following.

The drawings show.

DESCRIPTION OF THE PREFERRED EMBODIMENT

Figure 1:
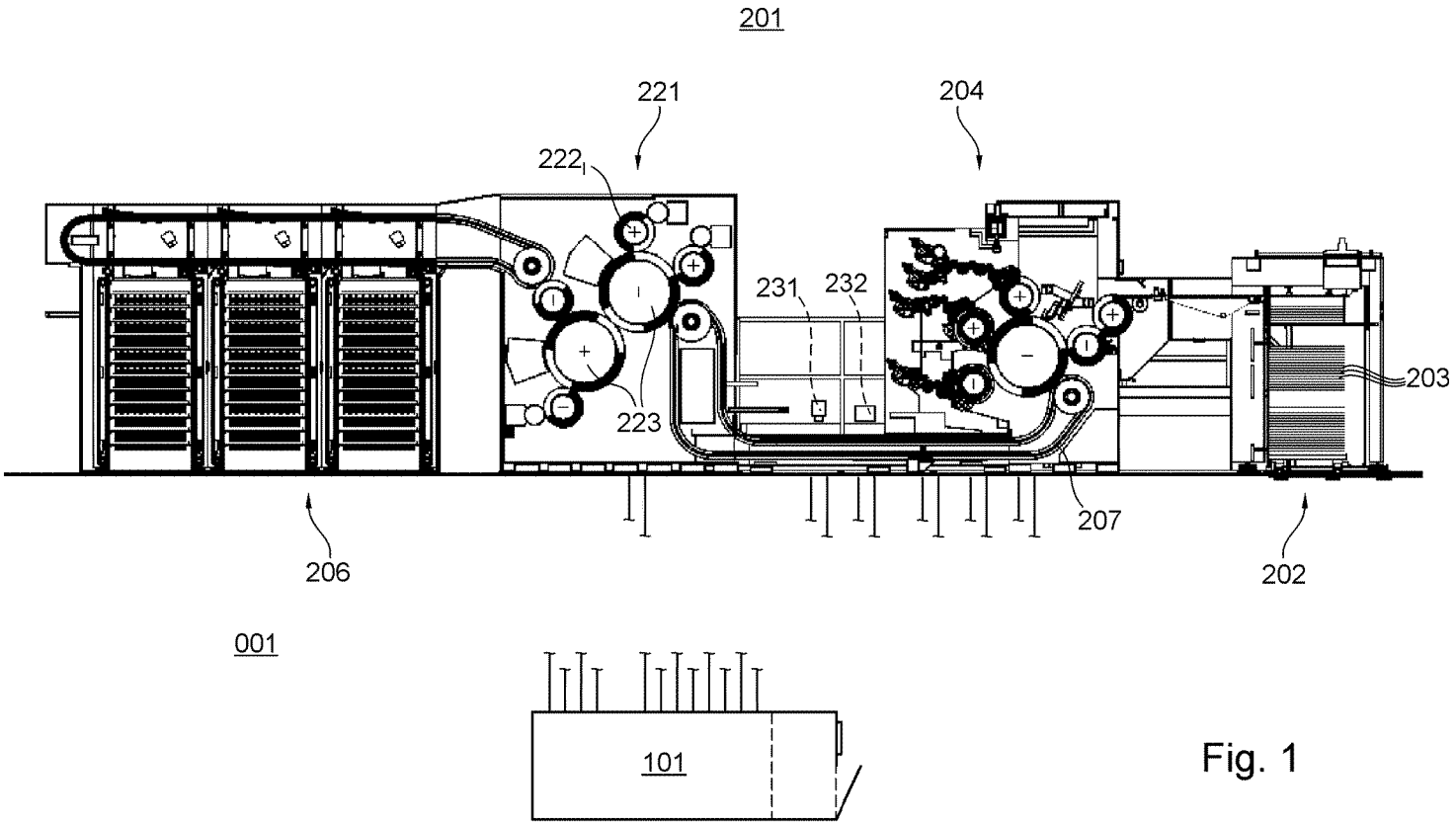
FIG. 1 a first exemplary embodiment of a system with a machine embodied as a printing machine and with a temperature control assembly.
Figure 2:
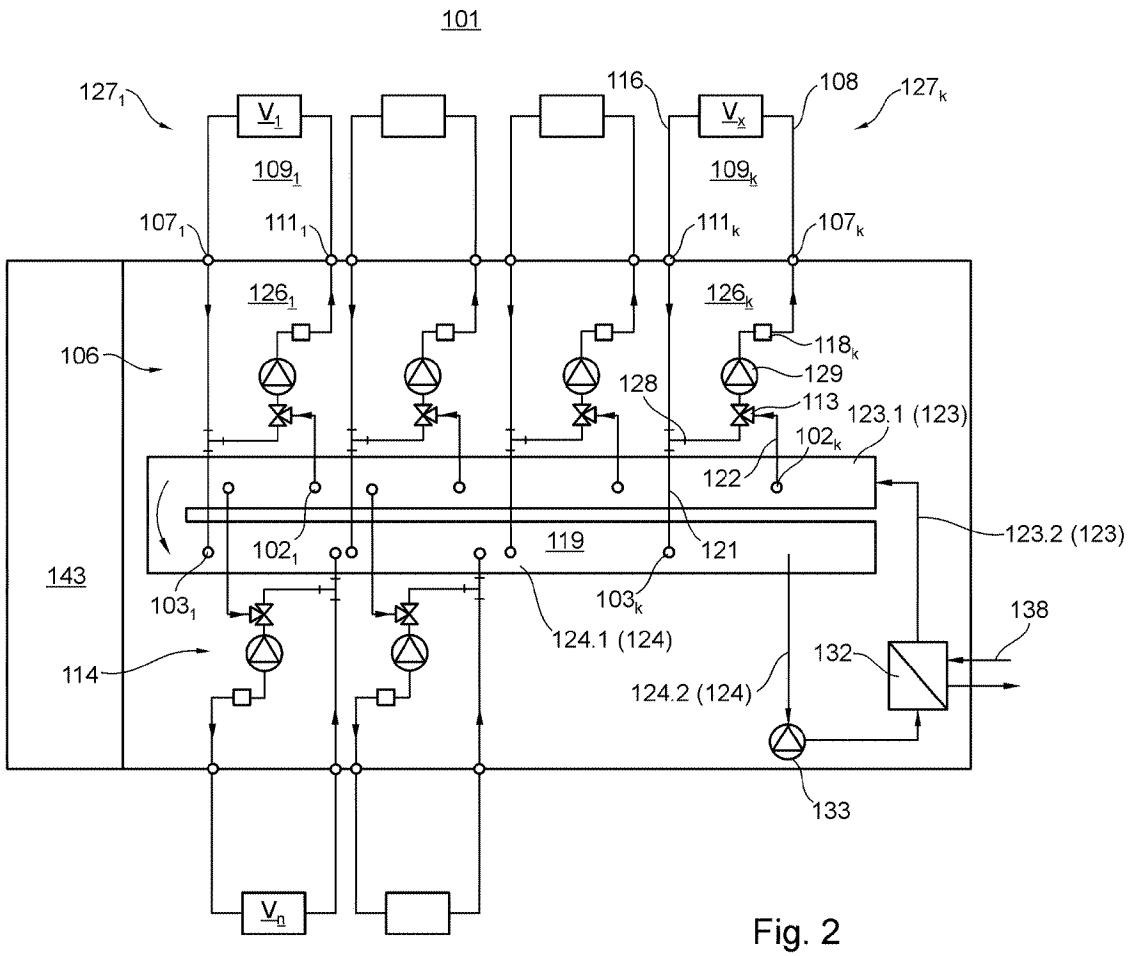
FIG. 2 a schematic diagram of an exemplary embodiment of a temperature control assembly.

A material preprocessing and/or processing system 001, for example a printing system 001, comprises, for example, one or more material preprocessing and/or processing machines 201, for example one or more printing machines 201, and at least one temperature control device 101, referred to or embodied, for example, as a temperature control assembly 101, for supplying temperature control fluid for controlling the temperature of a plurality of loads $V_x$ (with $x \in \{2, 3, 4, \ldots n\}$), each of which is or can be formed by transmitting means that act as heat exchangers, for example, functional parts and/or groups of functional parts, described in detail below, of one or more machines 201 of system 001, in particular of one or more printing machines 201 (see a printing machine 201 in FIG. 1, by way of example). The temperature control assembly 101 described in the following is advantageous in particular in an embodiment together with a printing machine 201 as set out below, but may also have particular advantages on its own in terms of ease of installation and/or variability and/or modularity, regardless of the specific application. By way of example, FIG. 1 shows a printing machine 201 comprising an infeed device 202 for feeding in a printing substrate 203, for example a sheet feeder 202, a printing assembly 204, for example a printing unit 204, a product delivery unit 206, for example a sheet delivery unit 206, and a conveyor path 207 between printing unit 204 and product delivery unit 206.

Without any loss of generality, functional parts that are to be temperature controlled and that are and/or can be coupled to the temperature control assembly 101 may include one or more cylinders 208; 213; 209; $\mathbf{227}_d$; 223 and/or inking rollers 214; $\mathbf{216}_d$; 217 and optionally also an inspection system 231 and/or a dryer 232 and/or frame parts (not shown).

Temperature control assembly 101 comprises a plurality of assembly-side temperature control subcircuits $\mathbf{126}_k$, the temperature of which is to be individually controlled, each having a temperature control fluid outlet $\mathbf{107}_k$ and a temperature control fluid inlet $\mathbf{111}_k$, to each of which, in order to form a respective temperature control circuit $\mathbf{127}_k$, an external temperature control subcircuit $\mathbf{109}_k$ that controls the temperature of one or more functional parts as loads $V_x$, to be described in detail below, can be connected by means of releasable connections. On the feed side, the temperature control subcircuits 126$_k$ can be or are thermally and/or fluidically coupled for the temperature control thereof to a common feed 123, in particular to a common supply feed line 123, or more succinctly feed line 123, which comprises one or more line sections 123.1; 123.2 and conducts temperature control fluid, and on the return side to a common return 124, in particular to a common supply return line 124, or more succinctly return line 124, which comprises one or more line sections 124.1; 124.2. Upstream, feed line 123 is line connected for the infeed thereof to a temperature control device 132, which controls the temperature of temperature control fluid to be fed into the feed 123. Common feed line 123 and temperature control device 132 are contained as components in the temperature control assembly 101, for example, on a single-part or multi-part frame 105 of the temperature control assembly 101. The temperature of each of the temperature control circuits 127$_k$ is controlled by means of temperature control units 112$_k$ that can be controlled and/or regulated independently of one another.

In temperature control assembly 101, the independently controllable and/or regulable temperature control units 112$_k$ are and/or can be provided in one or more parallel rows 106; 114, for example two such rows, extending in the longitudinal direction of feed line 123. In a refinement that can be readily sized to scale, a plurality of prepared coupling sites 131 are provided for receiving independently controllable and/or regulable temperature control units 112$_k$, configured as temperature control modules 112$_k$, and for coupling said units on the infeed side and the return side. In this case, it is not imperative for all coupling sites 131 in the finished temperature control assembly 101 to actually be occupied.

The components of temperature control assembly 101 can be provided in sections of temperature control assembly 101, which are created, for example, by a screening of cabinet sections produced by doors and/or reinforcing components, and/or by the arrangement in rows of individual cabinets or cabinet sections that are connected to one another, for example.

In principle, temperature control assembly 101 could also be configured as modular, with at least two sections embodied as modules, specifically at least one base module, which includes the temperature control device 132 and a drive means 133, for example a turbine 133 or, in particular, a pump 133, for example a primary circuit pump 133, and a connector module, which is or can be coupled to said base module and which has a plurality of temperature control units 112$_k$ that can be independently controlled and/or regulated for the purpose of controlling the temperature of the temperature control circuits 127$_k$. In that case, the base module and the connector module are each assigned line sections, which are or can be releasably connected to one another to form feed line 123 and return line 124.

In the following, the invention is described by way of example in the preferred form of a multi-row embodiment, however the invention should not be considered as limited to this configuration.

Temperature control assembly 101 comprises temperature control device 132, by means of which temperature control fluid is or can be provided on the outlet side, at a defined temperature $T_{V,v}$ that is at least within a permissible temperature range, for example at a temperature $T_{V,v}$ that is different from the ambient temperature, in particular lower than the ambient temperature, and is or can be supplied directly or via a supply line section 123.2 to a line section 123.1, for example, removal section 123.1, of feed line 123 that extends at least over the length from the first to the last downstream removal point 102$_k$ of the assembly-side temperature control subcircuits 126$_k$. The single-part or multi-part supply line section 123.2 between temperature control device 132 and the inlet into line section 123.1 is embodied, in particular, without additional fluid stores in which significant quantities of temperature control fluid would be or could be stored. This means, for example, that no expanded section, for example a container, in which the free flow cross-section is enlarged, is provided in supply line section 123.2 such that the average flow velocity in this container would drop to less than one-half, in particular less than one-third that of the remaining average supply line section 123.2 in this cross-sectional expansion or this container. This is not to be confused, however, with an optionally provided pressure equalization tank 137, through which fluid does not flow, but which can accommodate, as needed, a volume of fluid that is displaced by overpressure.

Temperature control device 132 is provided directly in the flow of fluid—that is, in particular, without diversion via a reservoir—between the last return point 103$_k$ and the first removal point 102$_k$. This means that at least a portion, and preferably the entire flow of temperature control fluid that is conducted in return 124 downstream of last return point 103$_k$ passes through temperature control device 132 in a forced flow on its way into the feed.

Figure 4:
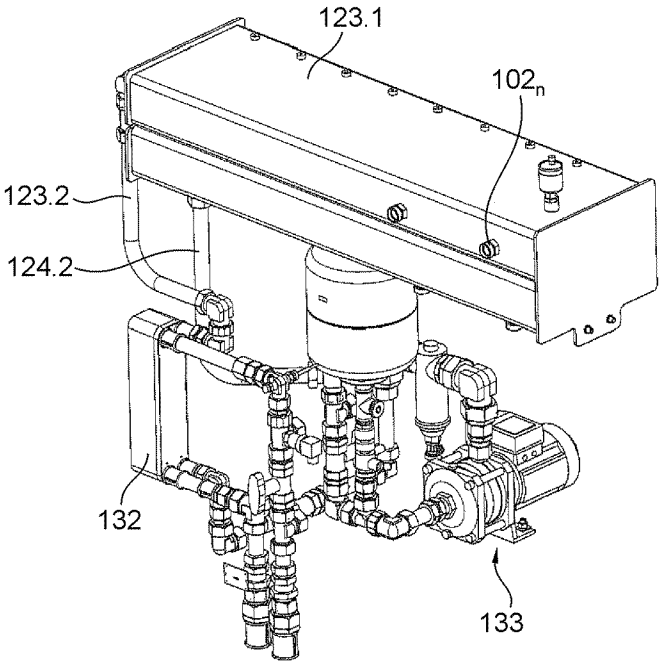
FIG. 4 a second perspective diagram of the feed and the return with a transport and preprocessing section arranged between return and feed.
Figure 3:
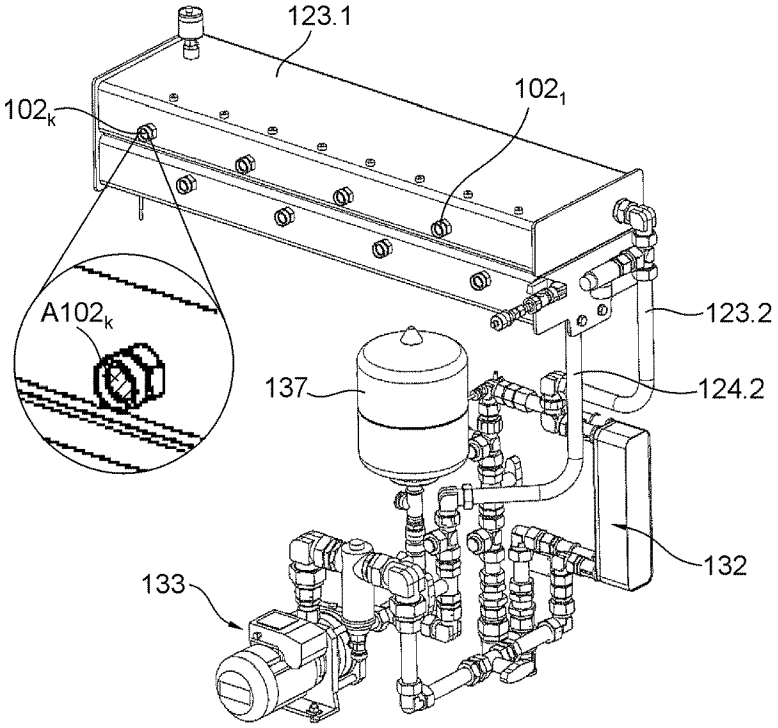
FIG. 3 a first perspective diagram of the feed and the return, with a transport and preprocessing section arranged between return and feed.
Figure 5:
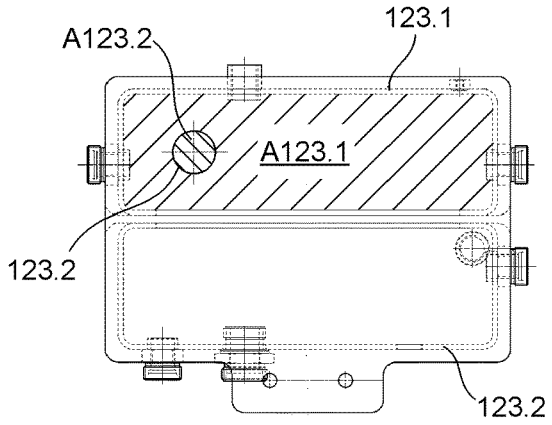
FIG. 5 a cross-sectional view of a component group comprising a feed-side line section and a return-side line section.
Figure 6:
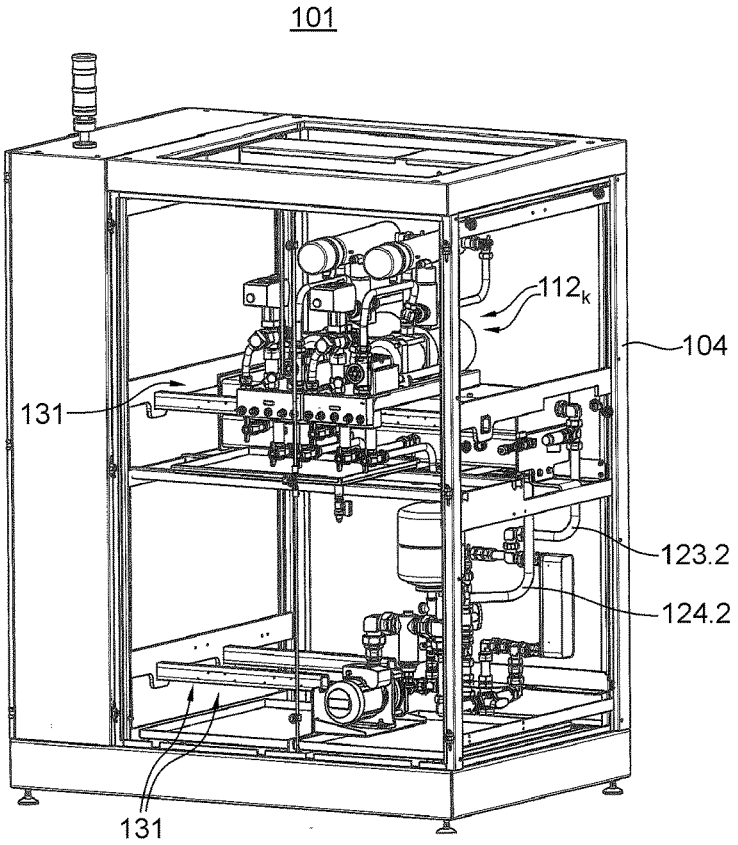
FIG. 6 a perspective diagram of a temperature control assembly with two temperature control modules provided or installed, by way of example.
Figure 7:
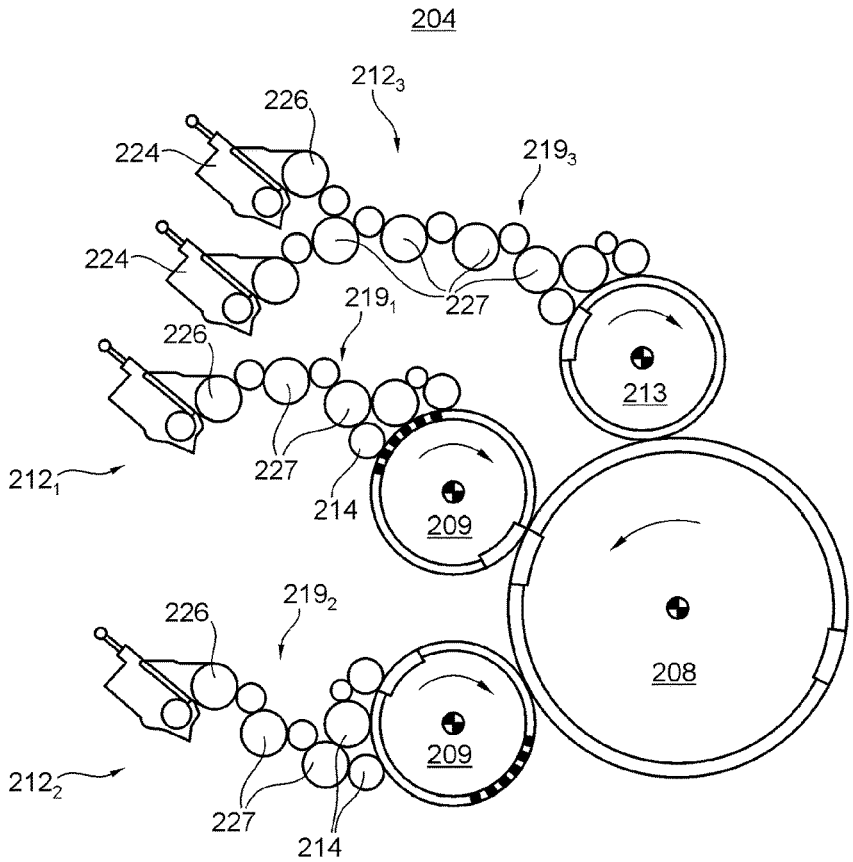
FIG. 7 a schematic diagram of an exemplary embodiment of a printing assembly of a printing machine to be temperature controlled, with a correspondingly configured temperature control assembly.
Figure 7:
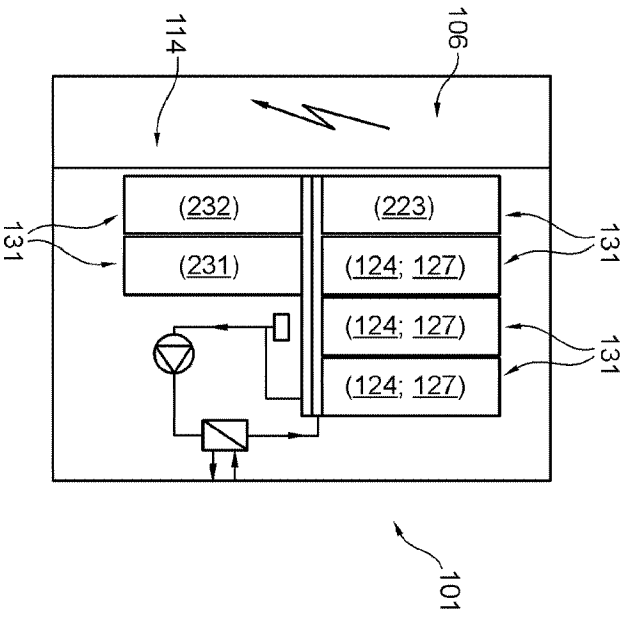

Line section 123.1 of feed line 123, also referred to as storage line section 123.1, has, at least over the length from the first to the last downstream removal point 102$_k$ of the assembly-side temperature control subcircuits 126$_k$, an average free line cross-section A123.1 as viewed over the length—optionally varying in sections—which is greater than a multiple of the average line cross-section A123.1 of a supply line section 123.2 located in feed 123 downstream of temperature control device 132 and upstream of this line section 123.1 and/or is greater than a multiple of a free line cross-section A102$_k$ at the respective or largest removal point 102$_k$ (see, for example, FIG. 3, FIG. 4 and FIG. 5). In particular, the average line cross-section corresponds to at least the sum of the line cross-sections of the removal points of all the temperature control medium circuits. The average free line cross-section A123.1, with a number of n temperature control fluid outlets 107$_k$, in particular, for example, at least four (n 4) temperature control fluid outlets 107$_k$, preferably corresponds to more than n times, for example, more than four times the average line cross-section A123.2 of supply line section 123.2 and/or of the free line cross-section A102$_k$ at the respective or largest removal point 102$_k$, with n=6 (as shown here by way of example) corresponding to more than six times.

This configuration of the fluid reservoir formed in feed 123 itself is particularly advantageous in conjunction with a self-contained primary circuit 119, in which return 124 on the outlet side is connected again to feed 123 on the inlet side via temperature control device 132.

Drive means 133 that pumps the fluid is preferably provided in the line path between the last return point 103, of return 124 and the first removal point 102$_1$ of feed 123.

A return-side line section 124.1 on the return side, for example return section 124.1, extending at least over the length from a first to a last downstream return point 103, from the assembly-side temperature control subcircuits 126$_q$, is connected on the outlet side via a return line section 124.2 to the inlet of temperature control device 132.

Return line section 124.2 between return-side line section 124.1 and temperature control device 132 is configured to conduct the fluid flow emerging from return-side line section

124.1 as such, that is to say, without intermediate blending in a fluid reservoir, to the inlet of temperature control device 132.

In an advantageous embodiment, feed-side line section 123.1 has a cross-sectional shape that differs from a circular disk-shaped cross-sectional shape, over at least the majority of its longitudinal extension.

In particular, it can have a cross-sectional shape with a straight or chord-like flattened portion, preferably a substantially rectangular cross-sectional shape, that is, with the exception of a rounding of each of the corners within the range of a maximum height of 10% of the respective side length.

In an embodiment which is advantageous in terms of a compact arrangement, both feed-side line section 123.1 and return-side line section 124.1 have a cross-sectional shape having a straight or chord-like flattened portion and/or a substantially rectangular cross-sectional shape on at least the mutually facing sides, at least over the majority of the longitudinal extension of each line section.

In a highly advantageous embodiment, in order to achieve a sufficiently high flow rate at all times and in particular during the start-up of temperature control, feed 123 and return 124 are fluidically connected to one another downstream of the last return point $\mathbf{102}_k$ from feed 123 and upstream of the first return point $\mathbf{103}_k$ into the return, via a connection 134 embodied as a passage 134 or fluid line 134.

Line sections 123.1; 124.1 that comprise removal and return points 192; 103*k*, respectively, can be formed, for example, by rectangular channels 123.1; 124.1. These can be connected to one another at one end via respective openings and optionally by a short transition piece. An open gap and/or insulating material may be provided between the mutually facing walls—outside of the connecting region—for thermal insulation. Channels 123.1; 124.1 can be configured as a single component in that they are fixedly connected to one another by a common frame or end-face plates and/or are surrounded—at least partially, predominantly, or optionally completely—by a common wall.

The temperature of the temperature control fluid that has been or will be fed into feed line 123 is, for example, 7° C. to 15° C., preferably 8° C. to 12° C.

For the sake of simplicity, feed line 123, return line 124 and the fluidic connection of return line 124 to the feed via temperature control device 132 are referred to here as primary circuit 119, regardless of whether or not in addition to the parallel branches via which the temperature control units $\mathbf{112}_k$ that control the temperature of the temperature control circuits $\mathbf{127}_k$, an aforementioned connection 134 is provided. If a connection 134 is additionally provided, a "true" primary circuit 119 in which fluid circulates is formed.

Temperature control assembly 101 is configured as having at least the number of n (n E N, preferably n 2) outlets $\mathbf{107}_k$, for example fluid outlets $\mathbf{107}_k$ (with k E N, k=1, 2 . . . n). The respective temperature control fluid outlets $\mathbf{107}_k$ form interfaces $\mathbf{107}_k$, which can each be coupled to temperature control circuits $\mathbf{127}_k$ by means of the external temperature control lines $\mathbf{109}_k$, on the inlet side thereof, for example in each case to feed lines 108 of the external temperature control lines $\mathbf{109}_k$. In particular, feed lines 108 of external temperature control lines $\mathbf{109}_k$ are to be or are preferably releasably connected to outlets $\mathbf{107}_k$. At each temperature control fluid outlet $\mathbf{107}_k$, temperature control fluid can be delivered to the respective temperature control line $\mathbf{109}_k$ that will be or is coupled thereto, at a temperature that is different from the ambient temperature. By means of the external temperature control lines $\mathbf{109}_k$ or the temperature control circuits $\mathbf{127}_k$ that are thereby formed, for example, respective consumers $V_x$ can be coupled and the temperature thereof controlled via the coupling.

Temperature control device 132 that controls the temperature of the fluid, in particular cools the fluid, can in principle be of any desired embodiment, for example in the form of a cooling assembly or a heat exchanger. Preferably, it is configured as a temperature control device 132 that is based solely on thermal contact, in other words without fluid exchange. It is preferably embodied as a heat exchanger 132, through which on one side, for example the side of the primary circuit 119, the temperature control fluid that is to be temperature controlled, for example the primary circuit fluid, flows or is to flow, and through which on the other side a temperature control medium 173 flows or is to flow, said fluid coming, for example, from an external source that is not assigned directly to temperature control assembly 101, for example from a source of heat and/or cold.

In principle, the means for thermal coupling or the transfer means that act as heat exchangers of any functional parts to be temperature controlled in a printing machine 201 of basically any embodiment can be coupled or coupleable individually or in groups as loads V. Preferably, however, functional parts of a printing machine 201 configured as a security printing machine 201 are or can be coupled. Functional parts embodied preferably as cylinders 208; 209; 213; $\mathbf{227}_d$; 223, in particular distribution cylinders $\mathbf{227}_d$ and/or forme cylinders 208; 213 and/or impression cylinders 208; 223, and/or as ink conducting devices, such as, in particular, ink sources 224 and, where appropriate, ink lines, and/or as an inspection device 231 and/or as a dryer 232 and/or as frame parts, can be or are coupled as functional parts.

In the particularly advantageous application described here by way of example, temperature control assembly 101 is or can be coupled to functional parts 208; 209; 213; 223; 224; $\mathbf{227}_d$; 231; 232 of a printing machine 201 that comprises a printing assembly 204 having at least one printing couple $\mathbf{212}_d$, configured, for example, as a numbering printing couple $\mathbf{212}_1$; $\mathbf{212}_2$. In particular, the printing assembly can comprise two printing couples $\mathbf{212}_d$ configured as numbering printing couples $\mathbf{212}_1$; $\mathbf{212}_2$.

The numbering printing couple $\mathbf{212}_1$; $\mathbf{212}_2$ in this case comprises a forme cylinder 209 configured as a numbering cylinder 209, which cooperates with one cylinder or with a common cylinder 208, for example impression cylinder 208, to form a print position. Numbering cylinder $\mathbf{209}_1$; $\mathbf{209}_2$ is inked up by one or preferably by a plurality of ink rollers 214, for example forme rollers 214, of an inking unit $\mathbf{219}_d$; $\mathbf{219}_1$; $\mathbf{219}_2$. The forme rollers 214 receive the printing ink via a roller train which comprises, for example, at least one oscillating distribution cylinder 227 and at least one additional inking roller 217, for example ink transfer roller 217, and at the upstream end, a first roller 226, for example a ductor or ink fountain roller 226, and an ink source 224, for example an ink fountain 224 or optionally a doctor blade chamber 224, that inks up said roller 226.

One or more distribution cylinders 227 of each printing couple $\mathbf{212}_d$, in particular, at least of each numbering printing couple $\mathbf{212}_1$; $\mathbf{212}_2$, can then be coupled or coupleable to the temperature control assembly 101 or to its internal temperature control subcircuits $\mathbf{109}_k$. In principle, each of these distribution cylinders 227 could be coupled or coupleable to a separate temperature control line, or all via the same temperature control line $\mathbf{109}_k$. Preferably, however, a different temperature control line $\mathbf{109}_k$ from every other printing couple $\mathbf{212}_1$; $\mathbf{212}_2$ is assigned to the one or more distribution cylinders 227 of each of the printing couples $\mathbf{212}_d$, in particular of both of the numbering printing couples $\mathbf{212}_1$; $\mathbf{212}_2$. The respective ink source 224 can also be coupled or coupleable for controlling the temperature thereof to the temperature control line $\mathbf{109}_k$ that is or can be coupled to the distribution cylinder(s) 227 of the respective printing couple.

In the advantageous embodiment described, printing assembly 204 can comprise a further printing couple $\mathbf{212}_3$, which is situated upstream of the two numbering printing couples $\mathbf{212}_1$; $\mathbf{212}_2$ for example, and operates according to a letterpress process, for example. Forme cylinder 213, which carries a letterpress forme, for example, also cooperates here for the purpose of inking up the forme cylinder with an inking unit $\mathbf{219}_d$, which likewise comprises one or more distribution cylinders 227, one or more transfer rollers 217, and at least one ink source 224 having a roller 226 that is or can be inked up by said source. One or more distribution cylinders 227 and optionally the one or more ink sources 224 of this additional printing couple $\mathbf{212}_3$ can be coupled or coupleable via an additional temperature control line $\mathbf{109}_k$ that is separate from the remaining printing couples $\mathbf{212}_d$.

In a refinement of printing machine 201, downstream of printing assembly 204, said machine can comprise a varnishing assembly 221, which includes one or more varnishing units 22, that cooperate with one or more impression cylinders 223. The impression cylinder(s) 223 and a cooling roller that may be provided downstream can be coupled or coupleable via at least one additional temperature control line $\mathbf{109}_k$ to the temperature control assembly 101.

In addition, an inspection device 331, optionally arranged downstream of printing assembly 204 in the printing substrate path, and/or a dryer 332, optionally arranged downstream of printing assembly 204 in the printing substrate path, can be coupled or coupleable each or via at least one additional temperature control line $\mathbf{109}_k$ to temperature control assembly 101.

While a preferred embodiment of a temperature control assembly for controlling the temperature of functional parts of a printing machine, and a printing system comprising at least one printing machine and a temperature control assembly have been set forth fully and completely hereinabove, it will be apparent to one of skill in the art that various changes can be made without departing from the true spirit and scope of the subject invention which is to be limited only by the appended claims.

The invention claimed is:

1. A temperature control assembly (101) for controlling the temperature of functional parts (208; 209; 213; 223; 224; $\mathbf{227}_d$; 231; 232) of a printing machine (201), wherein the temperature control assembly (101) comprises a plurality of assembly-side temperature control subcircuits ($\mathbf{126}_k$), the temperature of which is to be individually controlled, each having a temperature control fluid outlet ($\mathbf{107}_k$) and a temperature control fluid inlet ($\mathbf{111}_k$), to each of which, in order to form a respective temperature control circuit ($\mathbf{127}_k$), an external temperature control subcircuit ($\mathbf{109}_k$) that controls the temperature of one or more functional parts as loads ($V_x$) can be connected by means of releasable connections, and which on the feed side, for the temperature control of said subcircuit, is or can be thermally and/or fluidically coupled via respective removal points ($\mathbf{102}_k$) to a common feed line (123) and on the return-line side via respective return points ($\mathbf{103}_k$) to a common fluid return (124), and wherein the temperature control assembly (101) is configured as a structurally independent assembly, comprising the assembly-side temperature control subcircuits ($\mathbf{126}_k$) thereof and the feed and return (123; 124) and a temperature control device (132) that controls the temperature of the temperature control fluid to be supplied to the feed, on or in a single-part or multi-part frame (105) of the temperature control assembly (101), wherein the temperature control device (132) is provided in the fluid flow between the last return point ($\mathbf{103}_k$) and the first removal point ($\mathbf{102}_k$), characterized in that a line section (123.1) of the feed line (123), which extends at least over the length from the first removal point ($\mathbf{102}_1$) to the last downstream removal point ($\mathbf{102}_k$) of the assembly-side temperature control subcircuits ($\mathbf{126}_k$), has an average line cross-section (A123.1) which, in the case of a number n of temperature control fluid outlets ($\mathbf{107}_k$), corresponds to more than n times the average line cross-section (A123.2) of a supply line section (123.2) arranged in the feed (123) downstream of the temperature control device (132) and upstream of said line section (123.1), and/or corresponds to more than n times a free line cross-section (A$\mathbf{102}_k$) present at the respective or largest removal point ($\mathbf{102}_k$).

2. The temperature control assembly according to claim 1, characterized in that the average line cross-section (A123.1) corresponds to at least the sum of the line cross-sections (A$\mathbf{102}_k$) at the removal points ($\mathbf{102}_k$).

3. The temperature control assembly according to claim 1, characterized in that a number of at least four temperature control fluid outlets ($\mathbf{107}_k$) is provided, and in that the average line cross-section (A123.1) corresponds to at least four times the free line cross-section (A$\mathbf{102}_k$) at the respective or largest removal point ($\mathbf{102}_k$).

4. The temperature control assembly according to claim 1, characterized in that a drive means (133) for pumping the fluid is provided in the line path between the return (124) and the feed (123).

5. The temperature control assembly according to claim 1, characterized in that a second line section (124.1) on the return line side, extending from the assembly-side temperature control subcircuits ($\mathbf{126}_k$), at least over the length from a first return point ($\mathbf{103}_1$) up to a last return point ($\mathbf{103}_k$) downstream, is connected on the outlet side to the inlet of the temperature control device (132) via a return line section (124.2).

6. The temperature control assembly according to claim 5, characterized in that the return line section (124.2) is formed between the return-side line section (124.1) and the temperature control device (132) in order to feed the fluid flow as such emerging from the second line section (124.1) to the inlet of the temperature control device (132).

7. The temperature control assembly according to claim 1, characterized in that the first feed-side line section (123.1) has a cross-sectional shape that is different from a circular disk-shaped cross-sectional shape and/or a cross-sectional shape having a straight or chord-like flattened portion on at least one side and/or a rectangular cross-sectional shape, over at least the majority of its longitudinal extension.

8. The temperature control assembly according to claim 7, characterized in that the first feed-side line section (123.1) and the return-side line section (124.1) both have a cross-sectional shape having a straight or chord-like flattened portion and/or a rectangular cross-sectional shape on at least the mutually facing sides, over the majority of the longitudinal extension of each line section.

9. The temperature control assembly according to claim 1, characterized in that the feed line (123) downstream of the last removal point ($\mathbf{102}_k$) and the return line (124) upstream of the first return point ($\mathbf{103}_k$) are connected to one another in terms of flow via a connection.

10. The temperature control assembly according to claim 1, characterized in that controllable and/or regulable temperature control units (112$_k$) are provided for controlling the temperature of each of the temperature control circuits (127$_k$) independently of one another.

11. The temperature control assembly according to claim 10, characterized in that the temperature control units (112*k*) are configured as temperature control modules (112*k*) and can be arranged at coupling sites (131) that are provided in or on the frame (105) of the temperature control assembly (101) for receiving and for coupling said modules on the feed side and the return side.

12. A printing system (001) having at least one printing machine (201; 201; 201) and a temperature control assembly (101) for controlling the temperature of functional parts (208; 209; 213; 223; 224; 227$_d$; 231; 232) of said printing machine (201), characterized by the configuration of the temperature control assembly (101) according to claim 1.

13. The printing system according to claim 12, characterized by a printing machine embodied as a security printing machine.

14. The printing system according to claim 12, characterized in that the printing machine has at least one printing assembly (204) which has at least one printing couple (121$_d$) that comprises an inking unit (219$_d$), and in that at least one distribution cylinder (227) and/or at least one ink source (224) of the inking unit (219) are coupled to the temperature control assembly (101).

15. The printing system according to claim 14, characterized in that a numbering printing couple (121$_d$) is provided as the at least one printing couple (121$_d$).

* * * * *